US006051058A

United States Patent [19]

Crisci et al.

[11] Patent Number: 6,051,058

[45] Date of Patent: Apr. 18, 2000

[54] PROTECTIVE COATING COMPRISING BORON NITRIDE FOR REFRACTORY MATERIAL MEMBERS OF AN INGOT MOLD FOR CONTINUOUS CASTING OF METALS

[75] Inventors: Jean-Pierre Crisci, Echirolles; Christophe Ganser, Fameck; Jean-Michel Damasse, Isbergues, all of France; Wilhelm Schmitz, Baesweiler, Germany; Dieter Senk, Duisburg, Germany; Guido Stebner, Rheurdt, Germany

[73] Assignees: USINOR, Puteaux, France; Thyssen Stahl Aktiengesellschaft, Duisburg, Germany

[21] Appl. No.: 08/961,268

[22] Filed: Oct. 30, 1997

[30] Foreign Application Priority Data

Nov. 6, 1996 [FR] France ..... 96 13468

[51] Int. Cl.[7] ..... B28B 7/36

[52] U.S. Cl. ..... 106/38.22; 106/38.27; 106/38.28

[58] Field of Search ..... 106/38.22, 38.27, 106/38.28; 501/96.4

[56] References Cited

U.S. PATENT DOCUMENTS

| | | | |
|---|---|---|---|
| 2,726,160 | 12/1955 | Veltz . | |
| 4,003,867 | 1/1977 | Cooper et al. . | |
| 4,039,337 | 8/1977 | Brown et al. | 106/38.28 |
| 4,160,474 | 7/1979 | Pryor et al. | 106/38.28 |
| 4,529,028 | 7/1985 | Dybala et al. | 106/38.27 |
| 5,325,907 | 7/1994 | Nakabayashi et al. . | |
| 5,464,797 | 11/1995 | Yasrebi et al. | 106/38.27 |
| 5,573,580 | 11/1996 | Bartsch et al. | 106/38.27 |

FOREIGN PATENT DOCUMENTS

| | | |
|---|---|---|
| 2-120397 | 5/1990 | Japan . |
| 3-268849 | 11/1991 | Japan . |
| WO96/00626 | 1/1996 | WIPO . |

*Primary Examiner*—Karl Group
*Attorney, Agent, or Firm*—Nixon Peabody LLP; Thomas W. Cole

[57] ABSTRACT

The invention relates to a protective coating for a refractory material member of an ingot mold for continuous casting of metals, especially of steel, which consists of a dispersion of particles in a solvent, said particles including essentially boron nitride and at least one of the following metal oxides: zircon, zirconia, alumina and silica, the boron nitride representing between 20 and 50% by weight of said particles.

10 Claims, 1 Drawing Sheet

PROTECTIVE COATING COMPRISING BORON NITRIDE FOR REFRACTORY MATERIAL MEMBERS OF AN INGOT MOLD FOR CONTINUOUS CASTING OF METALS

FIELD OF THE INVENTION

The invention relates to the continuous casting of metals, especially of steel. More precisely, it relates to the various refractory material members which come into contact with the liquid metal in the ingot mold where the solidification of the cast product is initiated. Among these members there may be mentioned in particular the nozzles introducing the liquid metal into the ingot mold, as well as the side walls which, in continuous casting between rolls, ensure the confinement of the liquid metal between the cooled surfaces of said rolls.

PRIOR ART

An ingot mold for continuous casting of steel is composed essentially of metal walls (generally made of copper or copper alloy) which are energetically cooled internally and define a casting space, and against which the solidification of the steel is initiated. However, inside this ingot mold the liquid steel is also in most cases in contact with members made of refractory material. In the very great majority of continuous casting plants the molten metal is brought into the ingot mold by means of a nozzle made of a material such as graphited alumina, the lower end of which is immersed in the bath of metal already present in the ingot mold. Furthermore, the so-called "twin-roll casting" machines on which steel strips of very small thickness (of the order of a few mm) are cast, while making the steel solidify against the walls of two closely spaced, counterrotating rolls with horizontal shafts, have their casting space bounded laterally by two plates of refractory material which are applied against the planar faces of the rolls. The constituent material (s) of these plates may be especially silica, graphited alumina or other materials which combine, as well as is possible, a strong insulating power, a low reactivity with liquid steel and a high abrasion resistance, especially in the parts of the plates which are intended to rub against the casting rolls.

To prevent them from being subjected to an excessively large heat shock on their initial contact with the liquid metal, which would result in their destruction, and also to prevent them from causing an excessive cooling of the metal, these refractory members must be strongly preheated before the casting. However, this preheating promotes oxidation reactions and can therefore bring about a considerable deterioration of the member, in particular if the refractory material employed contains graphite in a significant quantity (this is the case especially with graphited alumina). It is therefore not always possible to reach a temperature as high as would be desired, or to maintain this temperature as long as would be necessary (when, for example, the casting must be delayed, whereas the preheating has already commenced). Furthermore, in the case of plates which laterally bound the casting space in twin-roll casting (plates which will be called "side walls" in the description which follows), it is desirable to coat them with a solid lubricant, at least on their parts which are intended to rub against the rolls, so as to limit their mechanical wear. This lubricant could advantageously be graphite, which is cheaper than, for example, boron nitride. However, a graphite layer exposed to air on a material being preheated or already preheated would unavoidably be consumed, and this solution cannot therefore be envisaged.

To solve the problem of the deterioration of the graphited refractories during the preheating it has been proposed in document U.S. Pat. No. 5,259,439 to coat them before the preheating with a surface layer delaying their oxidation. This layer may be a silicon-based ceramic varnish resistant up to preheating temperatures of 1200 to 1500° C. Such a coating is effectively suited to the function of protecting the refractory during the preheating, but it is consumed as soon as the casting begins, under the effect of its contact with the metal. Now, it would be advantageous to have available a coating that can protect the refractories for a longer period against the degradations which they undergo during the actual casting, as a result of the chemical reactions and the physical stresses to which they are subjected in contact with the liquid steel.

SUMMARY OF THE INVENTION

The objective of the invention is to propose a coating for refractory material members for continuous casting of metals, especially of steel, which can at the same time protect said members and their possible coatings against oxidation during the preheating, and also delay as long as possible the degradation of these members in contact with the casting itself.

To this end the subject of the invention is a protective coating for refractory material members of an ingot mold for continuous casting of metals, especially of steel, which consists of a dispersion of particles in a solvent, said particles including essentially boron nitride and at least one of the following metal oxides: zircon, zirconia, alumina and silica, the boron nitride representing between 20 and 50% by weight of said particles.

Another subject of the invention is a refractory material member of an ingot mold for continuous casting of metals, especially of steel, which is coated with a protective layer resulting from the application and then drying of a protective coating of the above type. This member may consist especially of a casting nozzle or a side wall for twin-roll casting. In this latter case the protective layer may cover a solid lubricant and/or a material releasing heat when it melts and dissolves in the liquid metal.

As will have been understood, the invention consists in coating the refractory member (casting nozzle or side wall for twin-roll casting in particular) with a protective coating consisting mainly of a mixture in a solvent (aqueous or other) of boron nitride and of one or of several oxides whose physicochemical characteristics are compatible with contact with the liquid metal. This coating is subsequently dried and the protective layer which results therefrom makes it possible to ensure a good protection of the refractory member (and of its possible oxidizable coating) against combustion or oxidation during the preheating. Also, during the casting, the presence of boron nitride provides the outer surface of the refractory member with a reduced wettability, and this appreciably slows down the chemical reactions between the member and the liquid metal. The service life of the member is thus increased if the protective layer is thick enough. In addition, this protective layer constitutes an insulating barrier which contributes to limiting the thermal degradation of the member.

BRIEF DESCRIPTION OF THE DRAWINGS

The invention will be understood better on reading the description which follows, given with reference to the single plate of drawings, in which.

DETAILED DESCRIPTION

Figure 1:
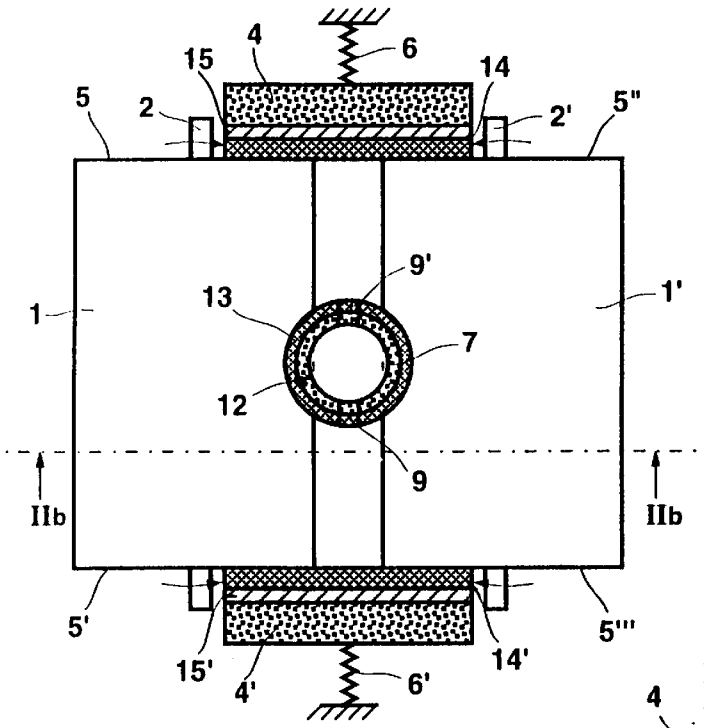
FIG. 1 shows diagrammatically in top view and in section along I—I an ingot mold for continuous twin-roll casting, equipped with side walls and with a casting nozzle according to the invention, as it is just before the beginning of the casting, when the plant has not yet received liquid steel.
Figure 2A:
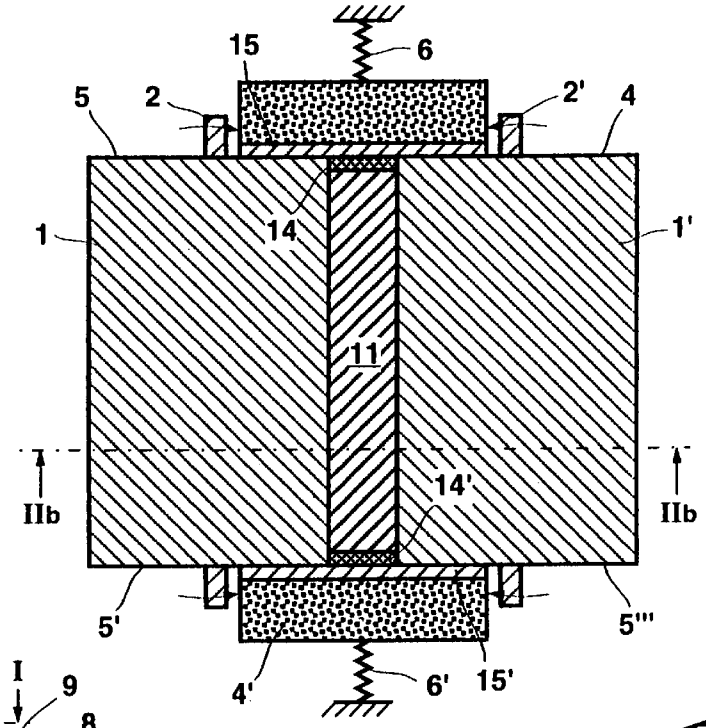
FIG. 2*a* shows the same ingot mold seen from the top and in section along IIa—IIa shortly after the beginning of the casting.
Figure 2B:
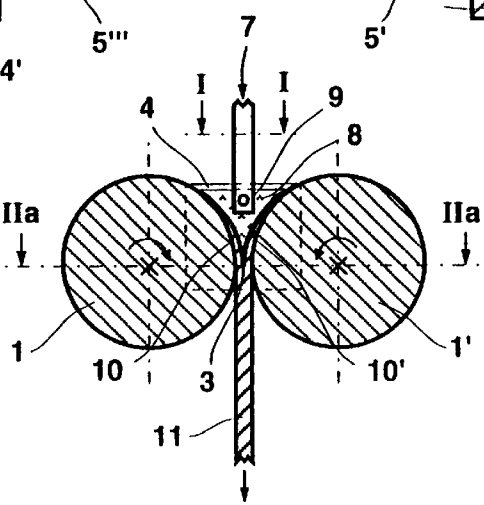
FIG. 2*b* shows the same ingot mold during casting, seen face-on and in section along IIb—IIb.

The plant for twin-roll casting of thin steel strips, shown in FIGS. 1, 2*a* and 2*b* comprises, in a known manner, two rolls 1, 1' with parallel and horizontal shafts 2, 2', energetically cooled internally and capable of being rotated in opposite directions about their shafts 2, 2' by conventional means, which are not shown. These two rolls 1, 1' usually have a diameter of the order of 600 to 1500 mm and a length of the order of 600 to 1500 mm. Their generatrices are separated by a minimum distance corresponding to the thickness of the strip which it is intended to cast, and the level 3 corresponding to this minimum distance is called "neck". Side walls 4, 4' consisting of a single insulating refractory material such as silica, graphited alumina or Sialon®, or of an assembly of several of these materials, are applied against the edges 5, 5', 5", 5'" of the rolls 1, 1', so as to close off laterally the casting space defined by the cooled side surfaces of the rolls 1, 1'. This application of the side walls 4, 4' is produced by virtue of means which are known per se and symbolized by the springs 6, 6'. A nozzle 7 made of refractory material, connected to a distributor, not shown, enclosing the liquid steel is for the purpose of bringing the liquid steel 8 into the casting space and is provided for this purpose with outlet ports 9, 9', each pointed towards one of the side walls 4, 4'. The liquid steel 8 solidifies against the cooled side surfaces of the rolls 1, 1' to form two solidified skins 10, 10' which are joined together substantially at the level of the neck 3 to form the cast strip 11 a few mm in thickness, which is extracted continuously from the ingot mold.

The external surface 12 of the nozzle 7 is coated with a protective layer 13 the thickness of which can reach a few mm (typically 0.5 to 2 mm). According to the invention this protective layer 13 has been produced from a coating consisting of a dispersion of particles in a solvent, said particles including essentially boron nitride and at least one of the following metal oxides: zircon, zirconia, alumina and silica, the boron nitride representing between 20 and 50% by weight of said particles. Detailed examples of such coatings with their methods of preparation will be given in the continuation of this description. After its application to the nozzle 7 this coating is dried and the nozzle 7 can then be preheated with a view to the casting. The protective layer 13 has a number of functions. The first, as in the case of the materials already known in the prior art, especially from the document U.S. Pat. No. 5,259,439, is to protect from oxidation the base refractory forming the nozzle 7 during the preheating. This is particularly useful when this refractory contains graphite, which is the case with graphited alumina, which is one of the materials most commonly employed for this purpose. However, in contrast to the materials cited by U.S. Pat. No. 5,259,439, the protective layers 13 of the invention have a high strength in contact with the liquid steel 8 and are not destroyed in the first moments of the casting if their thickness exceeds approximately 0.5 mm. This allows them to form a heat barrier between the liquid steel 8 and the base refractory of the nozzle 7, and as a result the latter is stressed less severely than in the absence of the protective layer 13. Also, however, the presence of a large quantity of boron nitride in the protective layer 13 provides this layer with low wettability by the liquid steel, and this limits the extent of the chemical reactions between the liquid metal 8 and the refractory of the nozzle 7. As a result, the reliability of the nozzle is increased and it can be employed for a longer period of casting.

Similarly, when being prepared, the side walls 4, 4' are coated with a protective coating according to the invention. Once the coating has dried, the side walls 4, 4' therefore comprise a protective layer 14, 14' a few mm in thickness (typically 0.5 to 2 mm). The side walls 4, 4' are then fitted onto the casting machine, preheated and finally applied against the edges 5, 5', 5", 5'" of the rolls 1, 1' by the springs 6, 6'. This is the state of the machine which is shown in FIG. 1. Generally, before the filling of the casting space by the liquid steel 8, the rolls 1, 1' are set in rotation, so as to produce a beginning of wear of the side walls 4, 4', which allows them to fit precisely the edges 5, 5', 5", 5'". An attempt is thus made to deal with possible irregularities in the shapes and the relative positioning of these members, which could compromise the leakproofing of the casting space. This operation produces at least partial wear of the protective layers 14, 14' everywhere that they rub against the rolls 1, 1', and they therefore project slightly inside the casting space. The latter is then filled by the liquid steel 8 and the casting commences. This is the state of the machine which is shown in FIGS. 2*a* and 2*b*. During the preheating of the side walls 4, 4' and the casting, the protective layers 14, 14' of the side walls 4, 4' are responsible for the same functions of thermal and chemical protection of the base refractory as the protective layer 13 of the nozzle 7, in particular if this base refractory contains graphite. Advantageously, as shown in the figures, during the preparation of the side walls 4, 4' a thin layer 15, 15' of a solid lubricant such as graphite or boron nitride has been deposited (for example by spraying) on the surface of their base refractory, before the application of the protective coating. The thickness of this lubricant layer 15, 15' is, for example, from 0.1 to 0.2 mm. In this way, during the casting and after the complete wear of the protective layer 14, 14' in the corresponding regions, the contacts between the side walls 4, 4' and the rolls 1, 1' take place through the intermediacy of this lubricant 15, 15'. As already said, the application of the protective coating allows all of this layer of lubricant 15, 15' to be preserved during the preheating of the side walls 4, 4' when it is easily combustible, as is the case with graphite. Experience shows that the graphite thus coated with the protective layer 14, 14' can stand up without damage to a preheating to 1000° C. for two hours.

Various alternative forms, such as those which will now be described, can also be applied to the side walls according to the invention.

In one alternative form shown in FIG. 3 the side wall 4 is coated with a succession of layers of different materials placed in the following order, starting from the surface which is intended to come into contact with the liquid metal and the rolls (the illustration is purely diagrammatic and, in particular, the scale of the thicknesses of the various layers is not obeyed).

Figure 3:
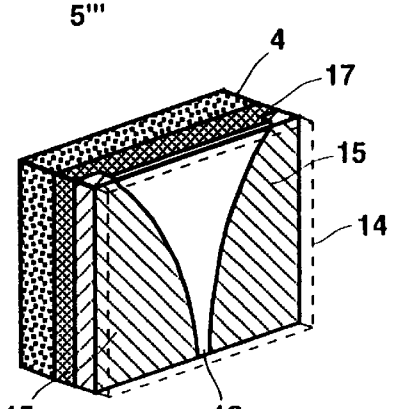
FIG. 3 shows diagrammatically, seen in perspective, an alternative form of the side walls according to the invention.

Firstly, there is to be found a protective layer 14, represented by dotted lines in FIG. 3, produced by application and drying of a coating according to the invention, intended, as already said, to protect the next layer against atmospheric oxygen during the preheating of the side wall.

Secondly there is to be found a layer made up of two parts. On the portions of the layer which are intended to rub against the rolls 1, 1' during the casting there is to be found a solid lubricant coating 15 based on graphite (for example), similar to that already described. On at least a part of the portion of the side wall which is intended to come into contact with the liquid metal, the solid lubricant is replaced by a material 16 which has the property of being exothermic when it is in contact with the liquid metal, while withstanding the temperatures reached during the preheating of the side walls. Especially in the case of steel casting it is possible, for example, to suggest that this material should consist of a sheet of an iron-aluminum alloy containing 70% of aluminum, which melts at 1170° C. The release of heat in contact with the liquid steel will be due, on the one hand, to the melting of the aluminum and, on the other hand, to its reaction with the oxygen dissolved in the liquid steel. The thickness of this sheet is a function of the quantity of heat which it is desired to introduce into the metal; it may be, for example, approximately 0.5 mm.

Thirdly, the lubricating material 15 and the exothermic material 16 are deposited on a second protective layer 17 produced by application and drying of a coating according to the invention. This second protective layer 17 must preferably be poor in oxides which can be easily reduced by the exothermic material (for example poor in silica in the case where the exothermic material is aluminum-based), so as not to be excessively damaged when the exothermic material melts. It itself is deposited on the refractory 4 forming the functional part of the side face.

In this example of side wall the surface protective layer 14 must be just thick enough to play its part as protection during the preheating, thus to be destroyed as soon as it first comes into contact with the liquid metal 8. After this rapid destruction the liquid metal 8 therefore comes into contact with the exothermic material 16, the melting and the dissolving of which result in a local heating of the liquid metal 8. The appearance of crusts of metal solidified on said side walls, especially in the lower part of the casting space, is thus avoided. These crusts could seriously perturb the proper progress of the beginning of the casting, and it is important to take action to prevent their formation. Simultaneously, as a consequence of the wear of the surface protective layer 14 when the rolls 1, 1' are set in rotation before the beginning of casting, the contact between the side wall and the rolls 1, 1' takes place through the intermediacy of the layer of solid lubricant 15. After the destruction of the exothermic material 16 the liquid metal comes into contact with the second protective layer 17. Thus, in the case where, as shown in FIG. 3, the layer of lubricant 15 has been given a greater thickness than that of the exothermic material 16, the configuration which is then encountered is the same again as that shown in FIG. 2*a*, with a protective layer 17 projecting slightly inside the casting space and capable of protecting sufficiently durably the refractory 4 of the side wall.

The example which has just been described is merely an alternative form of implementation of the invention, and modifications can be made to it, especially to the relative local thicknesses of the various protective layers 14, 17, of solid lubricant 15 and of exothermic material 16. In particular, the exothermic material 16 may cover only a part of the second protective layer 17 and may be present only in the regions where unwanted solidifications are most likely to appear (essentially in the neighbourhood of the neck 3 and of the edges of the rolls 1, 1'). In these conditions, wherever the exothermic material 16 is absent, the two protective layers 14 and 17 are in contact with one another and can be equivalent to a single layer if they are of the same kind. Furthermore, the second protective layer 17 may be present only in line with the casting space; in other words, the solid lubricant 15 may be applied directly onto the refractory 4 of the side wall. Finally, if it is not considered to be essential to protect the refractory 4 after the melting and the dissolving of the exothermic material 16, the second protective layer 17 can be dispensed with.

A series of nonlimiting examples of protective coatings based on oxide particles according to the invention and of their methods of preparation will now be given. It is to be understood that their essential common feature is that they comprise in suspension boron nitride particles which, if they represent 20 to 50% by weight of the dry materials employed to prepare the coating, provide the protective layers 14, 14' and 17 with a low wettability by the liquid steel.

EXAMPLE 1:

The following are mixed successively with stirring in 150 g of water:

- 75 g of an aqueous suspension of hexagonal boron nitride, marketed by ESK under the name "hBN";
- 75 g of an aqueous suspension of hexagonal boron nitride, containing 5 to 12% of α-alumina, marketed by Carborundum under the name BN Combat type E;
- and 150 g of a coating based on zircon ($ZrSiO_4$) with aluminum monophosphate $Al(H_2PO_4)_3$ bonding, marketed by Foseco under the name Koron RL 3190E and containing approximately 50% of $ZrO_2$, 27% of $SiO_2$, 14% of $P_2O_5$ and 4.5% of $Al_2O_3$.

The dry material corresponding to the various ingredients of this preparation contains in all approximately 30% of boron nitride. The coating of the side walls is preferably performed by the depositions of several successive layers, separated by drying stages, and ends with stoving at 120° C. The quantity prepared is sufficient to cover the two side walls of a plant for casting between rolls with a layer of 0.5–0.7 mm mean thickness.

EXAMPLE 2:

The following are mixed successively with stirring in 75 g of water:

- 75 g of zirconium acetate containing 21 to 23% of $ZrO_2$+$HfO_2$ (including approximately 2% of $HfO_2$) with a pH of 3 to 4;
- 30 g of boron nitride powder containing 0.3% of $B_2O_3$, which has a particle size of approximately 3 μm (reference Carborundum PSSP.151K);
- 175 g of the abovementioned suspension of hexagonal boron nitride ESK hBN;
- 225 g of the abovementioned zircon-based coating Koron RL3190E;
- 25 g of $Al(H_2PO_4)_3$ chemical binder of pH=2.2–2.5, marketed by Parker under reference FFB 32;
- and water in sufficient quantity to permit a good application of the coating, the latter being subsequently stoved as in the preceding example.

When compared with the preceding example, the presence of natural zirconia introduced by the zirconium acetate makes it possible to increase the corrosion resistance of the protective layer, since this coating is poorer in silica. This characteristic makes the protective layer suitable for being brought into contact with an aluminum-based exothermic material being melted, and this coating can therefore be employed for forming the protective layer 17 of the example of side wall described above and shown in FIG. 3. The following exemplary coatings, which do not contain zirconia and little or no silica, are also suitable for this use.

In the dry materials the approximate composition of the protective layer is 45% of Koron RL 3190E, 15% of zirconium acetate, 40% of boron nitride and 5% of chemical binder.

Sources of zirconia other than zirconium acetate can be employed, for example zirconium chloride or zirconium nitrate.

EXAMPLE 3:

9.5 g of Carborundum boron nitride powder PSSP.151K are mixed with stirring with 100 g of the zirconium acetate of Example 2, the side walls are coated and stoving is carried out. Under these conditions the dry coating is on average made up of 70% of zirconia and 30% of boron nitride. The high zirconia content guarantees an excellent corrosion resistance.

Here, too, sources of zirconia other than zirconium acetate can be employed.

Alternatively, a few % of zirconia can be replaced with chromium oxide $Cr_2O_3$, which also has an antiwetting action.

EXAMPLE 4:

The following are mixed successively with stirring into 100 g of an aqueous dispersion of alumina (21%), of silica (7%), and of $Na_2O$ (0.32%) at pH=9.5, marketed by Alcan Chemicals under reference Bacosol 75A:

30 g of Carborundum boron nitride PSSP.151K;

42 g of α-alumina powder of 1.1 μm mean particle size, marketed by Alcan Chemicals under reference BACO RA7;

10 g of Parker chemical binder FFB108, consisting of an alkali metal silicophosphate of pH=11, containing 3.5% of $P_2O_5$ and 18–19% of silica.

The water content is then adjusted to permit good application of the coating onto the side walls, which are stoved after the application.

The composition of the dry coating thus obtained is 63% of alumina, 7% of silica, 30% of boron nitride and 10% of chemical binder.

In general, the thicknesses of the protective layers thus implemented in the invention can range from a few 1/10 mm to a few mm.

It is to be understood that these coatings can be applied in the same way to the casting nozzle or to other refractory members which could be in contact with liquid steel (or with another metal whose physicochemical properties would be compatible with the use of the protective layers obtained) in an ingot mold for continuous casting.

Ceramic fibers based on zirconia, silica and/or alumina can also be advantageously incorporated into the various coatings which have been described. The function of these fibers is to increase the resistance of the protective layers formed from these coatings to thermal shocks.

We claim:

1. An aqueous mixture for making a protective coating for refractory material members of an ingot mold used for continuous casting of metals, said aqueous mixture comprising a dispersion of particles in an aqueous solvent, said particles consisting essentially of 20 and 50% by weight of hexagonal boron nitride and at least one metal oxide selected from the group consisting of zircon, zirconia, alumina and silica.

2. The aqueous mixture of claim 1, further comprising aluminum monophosphate.

3. The aqueous mixture of claim 1, wherein said alumina is α-alumina.

4. The aqueous mixture of claim 2, having a source of zirconia consisting essentially of zirconium acetate.

5. The aqueous mixture of claim 1, having a source of zirconia consisting essentially of zirconium oxide.

6. The aqueous mixture of claim 1, wherein all of said oxide consists essentially of zirconium acetate.

7. The aqueous mixture of claim 5, further comprising chromium oxide.

8. The aqueous mixture of claim 1, wherein said oxides consist essentially of oxides of alumina and silica and wherein said mixture further comprises a chemical binder.

9. The aqueous mixture of claim 8, wherein said chemical binder comprises an alkali metal silicophosphate.

10. The aqueous mixture of claim 1, wherein said particles are ceramic fibers consisting of at least one of zirconia, alumina and silica.

* * * * *